United States Patent [19]

Voso et al.

[11] 4,434,895

[45] Mar. 6, 1984

[54] STRAPPED WICKETED BAGS PACKET

[75] Inventors: Philip T. Voso, Tryon, N.C.; Billy B. Hallmark, Duncan, S.C.; Richard D. Thomas, Mauldin, S.C.; Benjamin G. Wofford, Spartanburg, S.C.

[73] Assignee: W. R. Grace & Co., Cryovac Division, Duncan, S.C.

[21] Appl. No.: 408,093

[22] Filed: Aug. 13, 1982

[51] Int. Cl.[3] ..... A45C 13/26; A45C 13/30

[52] U.S. Cl. ..... 206/554; 294/167; 294/149; 294/152; 248/95; 150/33

[58] Field of Search ..... 206/554, 509, 805; 229/53, 54 C, DIG. 6, 52 A, 52 AL; 294/158, 167, 164, 138, 145, 149, 151, 152, 154, 155, 159, 162, 163; 211/490; 221/312 A; 298/100, 95; 220/91, 92; 217/125; 150/33

[56] References Cited

U.S. PATENT DOCUMENTS

| | | | |
|---|---|---|---|
| 1,215,608 | 2/1917 | Anderson | 294/158 |
| 2,979,098 | 4/1961 | Greaves | 150/33 X |
| 3,184,055 | 5/1965 | Davis et al. | 206/554 |
| 3,198,325 | 8/1965 | White | 206/554 |
| 3,329,260 | 7/1967 | Medleycott | 229/53 |
| 3,338,398 | 8/1967 | Altman, Jr. | 206/554 |
| 3,563,433 | 2/1971 | Yoshiura et al. | 229/52 AL |
| 4,262,803 | 4/1981 | Nausedas et al. | 206/554 |
| 4,273,274 | 6/1981 | Freistadt | 150/33 X |
| 4,277,930 | 7/1981 | Nausedas et al. | 53/396 |
| 4,280,811 | 7/1981 | Howe, Jr. | 206/554 |

FOREIGN PATENT DOCUMENTS

| | | | |
|---|---|---|---|
| 2429721 | 2/1980 | France | 206/554 |
| 1481439 | 7/1977 | United Kingdom | 206/554 |

*Primary Examiner*—William T. Dixson, Jr.
*Assistant Examiner*—Bryon Gehman
*Attorney, Agent, or Firm*—John J. Toney; William D. Lee, Jr.; Frank A. Peacock

[57] ABSTRACT

A wicketed bags packet is provided that comprises a stack of flattened, flexible plastic bags having two wicket holes therethrough; wicket shanks extending through said wicket holes respectively; and elongate, flexible binding members crossed in an under-to-over pattern between said shanks and forming a handgrip for said packet, each said binding member being affixed to a shank, respectively, at the rear of said stack and extending to and being removably and reclosably affixed to the other of said shanks at the front of said stack. An associated method for dispensing wicketed bags is also provided.

17 Claims, 7 Drawing Figures

STRAPPED WICKETED BAGS PACKET

BACKGROUND OF THE INVENTION

This invention relates generally to wicketed packaging bags and more particularly to a packet of wicketed bags bound in a handgrippable and reclosable manner.

Packaging operations in industry, particularly in the meat packing industry, involve the use of flexible plastic packaging sheets or bags held on wickets passing through wicket holes in a stack of such sheets or bags for one at a time removal and utilization at a packing station. The packaging, handling, shipping, unpacking and mounting for utilization of these sheets and bags, because of their slippery surfaces, size and weight, present many problems. The desiderata of flattened, stacked, wicket-holed, flexible plastic packaging bags are that they be held bundled and neatly stacked, with the wicket holes in registration, as a unitary package, during packing, shipping, unpacking, and installation at a packing station and that the arrangement to accomplish these ends be optimally flexible to accomodate various modes of bag installation and mounting at different types of packing stations.

Of interest in this regard are the disclosures of U.S. Pat. Nos. 4,262,803 issued Apr. 21, 1981 and 4,277,930 issued July 14, 1981 to Nausedas et al for "Bags Wicketed on a Flexible Binding", directed to a stack of wicketed bags held on a flexible tubing binding threaded through the bag wicket holes to define a severable loop handle element, with shank elements passing through the wicket holes in the stacked bags, and with shank portion extensions adapted to secure the shank portion of the binding to wicket mounting means.

Of general interest is the disclosure of U.S. Pat. No. 3,198,325 issued Aug. 3, 1965 to White for "Bag Package", directed to a stack of packaging bags wicketed on tubes and retained by rounded inserts in said tubes over which said bags are pulled and stretched one at a time.

Of general interest is the disclosure of U.S. Pat. No. 3,338,398 issued Aug. 29, 1967 to ALtman for "Flexible Plastic Bag Package", directed to traditional wicketing of bags wherein a wicketed bag package is bound by a U-shaped fastening element having a pair of legs connected by a substantially straight bight portion, said legs extending downward through said openings with the bight portion extending across the front of the package and fastening means on the lower ends of said legs. During dispensing, bags are torn from the fastening element one at a time.

SUMMARY OF THE INVENTION

The present invention is directed to a unitary stack of wicket holed flexible plastic packaging bags wherein flexible binding holding an assembly of bags is also utilized as a carrying handle that further provides for reclosure of a partially used stack of bags.

Accordingly, there is provided a wicketed bags packet comprising a stack of flattened, flexible packaging bags having two wicket holes therethrough; wicket shanks extending through said wicket holes, respectively; and elongate, flexible binding members crossed in an under-to-over pattern between said shanks and forming a handgrip for said packet, each said binding member being affixed to a shank, respectively, at the rear of said stack and extending to and being removably and reclosably affixed to the other of said shanks at the front of said stack. Preferably, said binding members are straps. In another preferred embodiment, the invention provides for a stack of said packets with their wicket shanks being insertionally registered, further provided that a substantially rigid bight element is affixed to and extends between said shanks at the rear of said stack.

Additionally, there is provided a method for dispensing wicketed bags, comprising providing a stack of flattened, flexible packaging bags having two wicket holes therethrough held assembled on wicket shanks extending through said wicket holes, respectively, by elongate, flexible binding members crossed in an under-to-over pattern between said shanks and forming a handgrip for said packet, each said binding member being affixed to a shank, respectively, at the rear of said stack and extending to and being removably and reclosably affixed to the other of said shanks at the front of said stack; then placing said stack on a dispensing surface; removing said binding members from their respective frontal affixments to said shanks; and then repeatedly removing the frontal bag from said stack. In a preferred mode, the method further comprises mounting said stack on a dispensing base adapted to secure said shanks at the rear of said stack.

BRIEF DESCRIPTION OF THE DRAWINGS

Further details are given below with reference to the embodiments shown in the drawings wherein.

DESCRIPTION OF THE PREFERRED EMBODIMENTS

Figure 1:
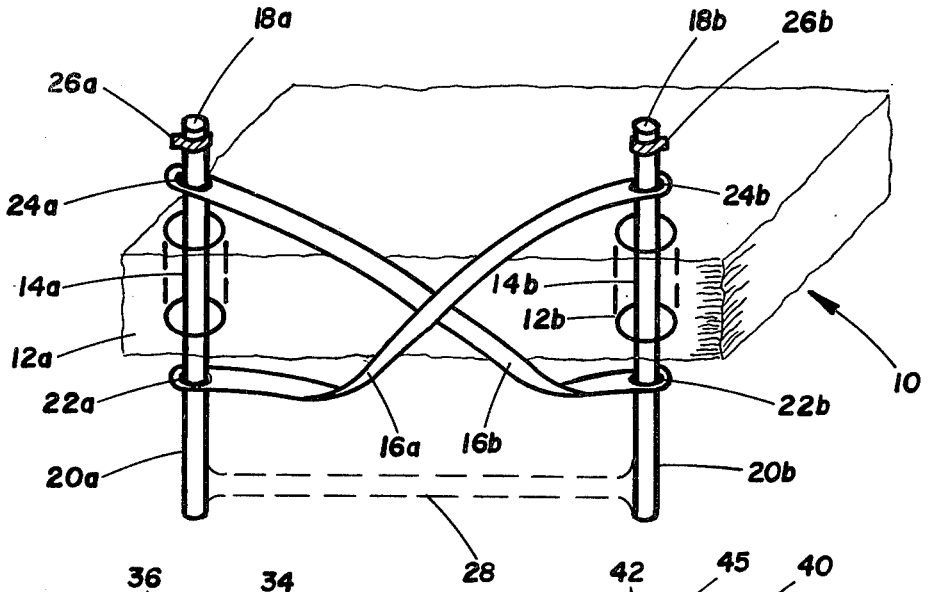
FIG. 1 shows a strapped wicketed bags packet in accordance with the present invention.

Referring specifically to the drawings, in FIG. 1 a strapped wicketed bags packet in accordance with the present invention is shown. Generally speaking, the wicketing system is a convenient, simple approach to securing a stack of packaging bags in wicketed form that also provides for reclosure of a partially used stack of bags and serves as an especially comfortable handgrip for handling the bags packet. No tools are needed to open or reclose the wicketed packet, and the configuration is adapted to be readily interchangeable among a wide variety of bag loading stations. Another advantageous feature of the handgrip configuration of the wicketing system is that in lifting a wicketed packet the weight of the packet is substantially evenly distributed over the handgrip thus promoting comfort in handling. Further, as discussed below, in certain embodiments a plurality of such packets may be stacked at a loading station. It is noted that the invention is adapted to accommodate a wide variety of planar packaging material, including bags or sheets of packaging film. Thus, the term "bags" is to be interpreted broadly to include end-sealed bags, side-sealed bags, pouches, and the like, and in general any type of planar packaging material.

Starting with a stack of packaging bags 10, wicketing elements 12*a,b* secure the wicketed configuration. Wicket shanks 14*a,b* extend, respectively, through wicketing holes through the bag stack, for example, at the open end of the stack. The shanks protrude from the front of the bag stack as indicated at 18*a,b* and from the rear of the bag stack as indicated at 20*a,b*. Wicketing elements 12*a,b* have, respectively, flexible binding members 16*a,b* which are affixed to their respective shanks at the rear of said bag stack as indicated at 22*a,b* and are crossed in an under-to-over pattern to the front of the bag stack where they are attached to their respective opposite shanks as indicated at 24*a,b*. Frontal affixments 24*a,b* are such that binding members 16*a,b* are removable from their respective shanks to open the packet for bag dispensing, but which may readily be reaffixed in the event a partially used bag packet is to be resecured. Thus, the frontal affixments are said to be reclosable. Binding members 16*a,b* are preferably flexible plastic straps, made of polyethylene for example, and their crossed under-to-over pattern forms an especially comfortable handgrip for carrying a closed packet. Frontal affixments 24*a,b* and rear affixments 20*a,b* are shown only generally since various modes of these affixments are representatively shown in detail in the figures to follow. However, for purposes of discussing FIG. 1 generally, these affixments may be considered to be friction fits. Optionally, the wicketed packet may be further secured by tape segments 26*a,b* on the wicket shanks over the binding straps at their respective frontal affixments to shanks 14*a,b* which are removed once the packet is situated at a packaging station. Optionally, the binding straps may be unitarily molded in the crossed configuration. A further option, as will be discussed below, is the inclusion of substantially rigid bight element 28 (indicated by dashed lines) which is affixed to and extends between said shanks at the rear of the packet. Bight 28 provides for bag dispensing at a loading station not having means to secure shanks 14*a,b* to a dispensing surface. Further, this option permits stacking of a plurality of said wicketed packets at a loading station.

Figure 2A:
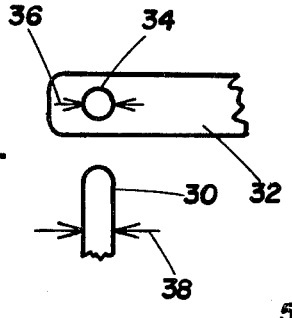
FIGS. 2A,B,C show various modes for reclosably affixing binding straps to wicket shanks extending from the front side of said wicketed bags packet.
Figure 2B:
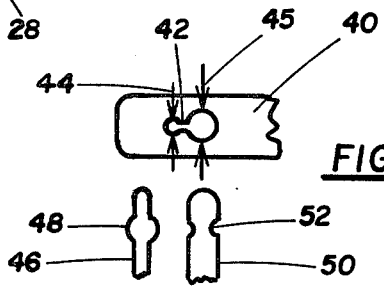
Figure 2C:
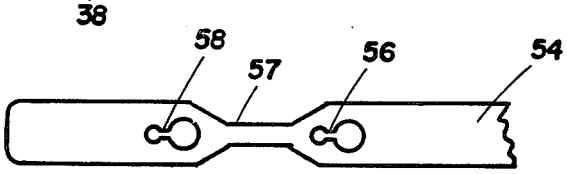
Figure 2C:
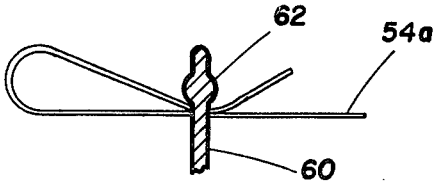

FIGS. 2A,B,C show various modes for reclosably affixing binding straps at the front side of said wicketed bags packet. In FIG 2A, there is shown a frontal affixment mode of the friction fit type, wherein strap 32 having hole 34 of diameter indicated at 36 tightly fits over shank 30 having a circular transverse cross-section of diameter 38 being about equal to hole diameter 36. In FIG. 2B, a single key lock frontal affixment is shown in two alternatives. A binding strap 40 has key lock opening 42 which has locking or minimum diameter 44. In one alternative, shank 46 provides a convex male member of the single key lock set. Shank 46 is generally tubular in shape but having a bulbous convex retaining protrusion 48 near the frontal end of the shank. The diameter of shank 46 is substantially equal to minimum diameter 44 of key lock opening 42 whereas the diameter of convex protrusion 48 is about equal to major diameter 45 of key lock opening 42. Thus, in use strap 40 is placed onto shank 46 by passing shank 46 through major diameter 45 below convex protrusion 48; then strap 40 is pulled laterally until minimum diameter 44 encircles shank 46. Alternatively, the male member of the single key lock set may be provided in concave fashion as shown by shank 50 having concave recession 52 extending circumferentially about shank 50 near the front end of said shank. The diameter of shank 50 is about equal to major diameter 45, and the diameter of concave recession 52 is about equal to minimum diameter 44 so that strap 40 locks onto shank 50 when minimum diameter 44 is pulled into concave recession 52. A key aspect of the single key lock mode of frontal affixment is that the male member of the key lock set has no abrupt edges, so that during dispensing of bags from the opened wicketed packet, bags do not grab on any abrupt protrusions from the wicketing shanks. In FIG. 2C, a preferred mode of frontal affixment is shown, which is a double key lock configuration being similar to the single key lock configuration. A strap 54 has two key lock openings 56 and 58 separated by necked portion 57 to promote flexibility of strap 54 during locking. The male member of the double key lock set may be of either of the concave or convex mode, the convex mode being specifically shown such that shank 60 has convex protrusion 62 which retains strap 54 in the locked position 54*a*. Thus in use, the major diameter of key lock opening 56 is passed over shank 60 below convex protrusion 62, then strap 54 is pulled laterally to lock the minimum diameter of key lock opening 56 about the circumference of shank 60. Strap 54 is then folded at necked portion 57, and the locking sequence is repeated using key lock opening 58 thereby completing the double key locked configuration for additional security of the closed packet.

Figure 3A:
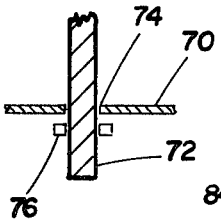
FIGS. 3A,B,C show various modes for affixing binding straps to wicket shanks extending from the rear of said wicketed bags packet.
Figure 3B:
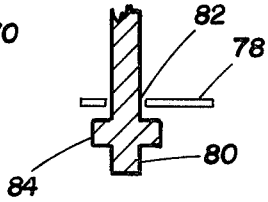
Figure 3C:
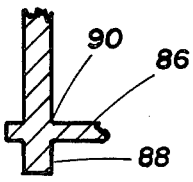

FIGS. 3A,B,C show representative modes for affixing binding straps to wicket shanks at the rear of a wicketed bags packet. In FIG. 3A, there is shown a friction fit of strap 70 over the rear end of shank 72 indicated at 74 and further secured by friction washer 76. Thus, the rear affixment of a binding strap is considered to be permanent. In FIG. 3B, a variation is shown wherein strap 78 fits over shank 80 with a friction fit as indicated generally at 82 and is further retained by molded projection 84, i.e. projection 84 is integral to shank 80. In FIG. 3C, yet another variation of the rear affixment is shown, wherein strap 86 is an integral part of shank 88 being a molded extension as indicated at generally at 90. This integral configuration for rear affixment is preferred for reasons of appearance and economy.

The wicketed bags packet of the invention can be readily lifted using the handgrip formed by the crossed binding straps from a shipping carton and carried to a packing station for installation in bag dispensing apparatus, or for any other necessary handling. At a conventional packing station, a bags packet will be placed on a dispensing surface adapted to secure the wicketing shanks at the rear of the bag packet, by for example fitting the shanks over wicket pins extending from the dispensing surface or alternatively by fitting the rear extension of the shank into sockets in the dispensing surface. In the case where the shanks are fitted over pins on a dispensing surface, the shanks are preferably hollow tubes. Having mounted the packet on a dispensing surface, the packet is opened by removing the binding straps of the packet from their respective frontal affixments to the wicketing shanks, and bag removal proceeds one at a time by removing the frontal bag over the shanks without tearing the bags. If packing is interrupted, the partially used packet may be reclosed by resecuring the binding straps at their previous respective frontal affixments, and the reclosed packet removed from the dispensing surface by handling with the handgrip formed by the crossed binding straps. Thus, the present invention promotes economy in packing operations in that loose bag situations are eliminated. Loose bags are generally considered as waste.

In another mode of the invention wherein the wicketing system includes a substantially rigid bight extending between the wicket shanks at the rear of the packet, a packet may be dispensed from any generally horizontal dispensing surface without need of means for securing the wicket shanks to said surface. Further, a plurality of wicketed bags packets may be stacked at a loading station when the ends of the shanks are adapted for serial fitment of their respective shanks. For example, wicket shanks may be hollow tubes having a flared end to extend from the rear of a wicketed packet such that when a wicketed packet is stacked on top of another the flared shank at the rear of an upper packet fits snugly over the shanks at the front of the underlying wicketed packet. This mode promotes economy in packing operations since work at a loading station is interupted fewer times for replacing depleted bag packets.

Although the present invention has been described in conjunction with preferred embodiments, it is to be understood that modifications and variations may be utilized without departing from the principles and scope of the invention, as those skilled in the art will readily understand. Accordingly, such modifications and variations may be practiced within the scope of the following claims:

What is claimed is:

1. A wicketed bags packet, comprising:

(a) a stack of flattened, flexible packaging bags having two wicket holes therethrough;

(b) wicket shanks extending through said wicket holes, respectively; and (c) elongate, flexible binding members crossed in an under-to-over pattern between said shanks and forming a handgrip for said packet, each said binding member being affixed to a shank, respectively, at the rear of said stack and extending to and being removably and reclosably affixed to the other of said shanks at the front of said stack, said binding members being adapted to be reclosed over said stack thereby to reform said handgrip during interruption in dispensing said bags from said stack.

2. The packet of claim 1 further comprising means for mounting said stack on a dispensing base adapted to secure said shanks at the rear of said stack.

3. The packet of claim 1 further comprising a substantially rigid bight affixed to and extending between said shanks at the rear of said stack and means for serially stacking a plurality of said packets with their wicket shanks fitting insertionally registered.

4. The packet of claim 1, 2, or 3 wherein said binding members are straps.

5. The packet of claim 4 wherein said straps are unitarily formed in the crossed configuration.

6. The packet of claim 1, 2, or 3 wherein said binding members are frontally affixed to said shanks by a friction fit.

7. The packet of claim 1, 2, or 3 wherein said binding members are frontally affixed to said shanks by a single key lock.

8. The packet of claim 7 wherein the male portion of said single key lock is convex.

9. The packet of claim 7 wherein the male portion of said single key lock is concave.

10. The packet of claim 1, 2, or 3 wherein said binding members are frontally affixed to said shanks by a double key lock and wherein the male portion of said double key lock is convex.

11. The packet of claim 1, 2, or 3 wherein said binding members are affixed to said shanks at the rear of said packet with a friction washer.

12. The packet of claim 1, 2, or 3 wherein said binding members are retained on said shanks at the rear of said packet with an integral projection from said shanks.

13. The packet of claim 1, 2, or 3 wherein said binding members are affixed to said shanks at the rear of said packet by being unitarily formed therewith, respectively.

14. A method for dispensing wicketed bags, comprising:

(a) providing a stack of flattened, flexible packaging bags having two wicket holes therethrough held assembled on wicket shanks extending through said wicket holes, respectively, by elongate, flexible binding members crossed in an under-to-over pattern between said shanks and forming a handgrip for said packet, each said binding member being affixed to a shank, respectively, at the rear of said stack and extending to and being removably and reclosably affixed to the other of said shanks at the front of said stack;

(b) placing said stack on a dispensing surface;

(c) removing said binding members from their respective frontal affixments to said shanks; and then repeatedly (d) removing the frontal bag from said stack; and (e) reclosing said binding members over said stack during any substantial interruption in dispensing thereby reforming said handgrip.

15. The method of claim 14 further comprising mounting said stack on a dispensing base adapted to secure said shanks at the rear of said stack.

16. The method of claim 14 further comprising placing a plurality of said stacks on a substantially horizontal dispensing surface, further provided that a substantially rigid bight is affixed to and extends between said shanks at the rear of said stack, said plurality being serially arranged with their respective shanks insertionally registered.

17. The method of claim 14 wherein said binding members are frontally affixed using a key lock having a convex male member, said convex member presenting low resistance to removal of said bags from said shanks during said dispensing.

* * * * *